United States Patent [19]

Otsubo

[11] Patent Number: 4,723,338

[45] Date of Patent: Feb. 9, 1988

[54] SUCTION CLEANING DEVICE

[76] Inventor: Hirofusa Otsubo, 5085 Broadway, Apt. 4C, New York, N.Y. 10034

[21] Appl. No.: 934,466

[22] Filed: Nov. 24, 1986

[51] Int. Cl.[4] ..... A47L 9/02

[52] U.S. Cl. ..... 15/331; 15/414; 15/416

[58] Field of Search ..... 15/416, 331, 335, 414

[56] References Cited

U.S. PATENT DOCUMENTS

| | | | |
|---|---|---|---|
| 1,338,791 | 5/1920 | Replogle | 15/335 |
| 1,860,854 | 5/1932 | Engberg et al. | 15/416 |
| 3,259,934 | 7/1966 | Leinfelt | 15/416 X |
| 4,519,113 | 5/1985 | Hipple | 15/335 |
| 4,653,137 | 3/1987 | Fleischhauer | 15/416 X |

FOREIGN PATENT DOCUMENTS

| | | | |
|---|---|---|---|
| 1173623 | 7/1964 | Fed. Rep. of Germany | 15/416 |
| 2053055 | 5/1972 | Fed. Rep. of Germany | 15/416 |

*Primary Examiner*—Chris K. Moore

*Attorney, Agent, or Firm*—Robert S. Salzman

[57] ABSTRACT

The invention features a suction cleaning device for cleaning hard-to-access areas such as crevices and corners.

A crevice tool in the form of an extendable wand is disposed within a floor or rug attachment.

The wand is built-in to the housing of the floor or rug attachment and does not require removal or change of attachments to actuate the crevice tool, thus providing convenience and a saving of time.

5 Claims, 4 Drawing Figures

SUCTION CLEANING DEVICE

FIELD OF THE INVENTION

The invention relates to a vacuum cleaning device and more particularly to a suction cleaning device that reaches into hard-to-access areas such as cracks and crevices.

BACKGROUND OF THE INVENTION

Vacuum cleaners are provided with many kinds of cleaning attachments. Some of the many types of attachment are specifically for rugs and carpets, and comprise elongated cup-shaped housings that affix to the end of a hollow tube extension.

These types of attachment often contain bristle combs for brushing and straightening the carpet fibers, so that the suction can reach deeply into the fiber mat. Some of the bristle combs are mounted on rotatably driven rollers that beat as well as comb the fiber mass.

While these rug and carpet attachments provide good cleaning in readily accessible carpet areas, they often have little or no usefulness in crevices, corners or other generally inaccessible areas.

A crevice tool or other wand-like attachment is usually provided for these hard-to-reach places. Often, the user is forced to change attachments several times in the course of cleaning a rug. The constant removal and insertion of these attachments is both time consuming and inconvenient.

The present invention provides a floor attachment that has a built-in crevice tool that is slidably engaged or disengaged without having to remove or insert any attachments. Thus, the user is able to continuously clean a rug, floor, or carpet without being inconvenienced.

BRIEF SUMMARY OF THE INVENTION

The invention pertains to a floor cleaning attachment for a vacuum cleaning system having a built-in crevice tool. The floor attachment comprises a housing having a bifurcated internal conduit. One section of the conduit is directed towards the rug or carpet, and provides suction thereto. The other section of the bifurcated conduit opens into the forward face of the housing, and supports a slidably projectible crevice tool that extends ahead of the housing in order to reach inaccessible places.

The crevice tool is slidable from an internal or retracted position to an external or extended position, without removing or changing the floor attachment.

A slidable knob positioned on the suction tube is attached to the internally disposed crevice tool, and is operative to actuate the crevice tool by manually sliding forward with respect to the suction tube.

DETAILED DESCRIPTION OF THE INVENTION

Generally speaking, the invention features a built-in crevice wand disposed within a floor or rug attachment of a vacuum cleaning system. The built-in wand is operable to clean hard-to-access places without having to change or remove the attachment, thus providing the user with a floor or rug cleaning device that is both convenient and time conserving.

For purposes of brevity, like elements will have the same designations throughout the figures.

Figure 1:
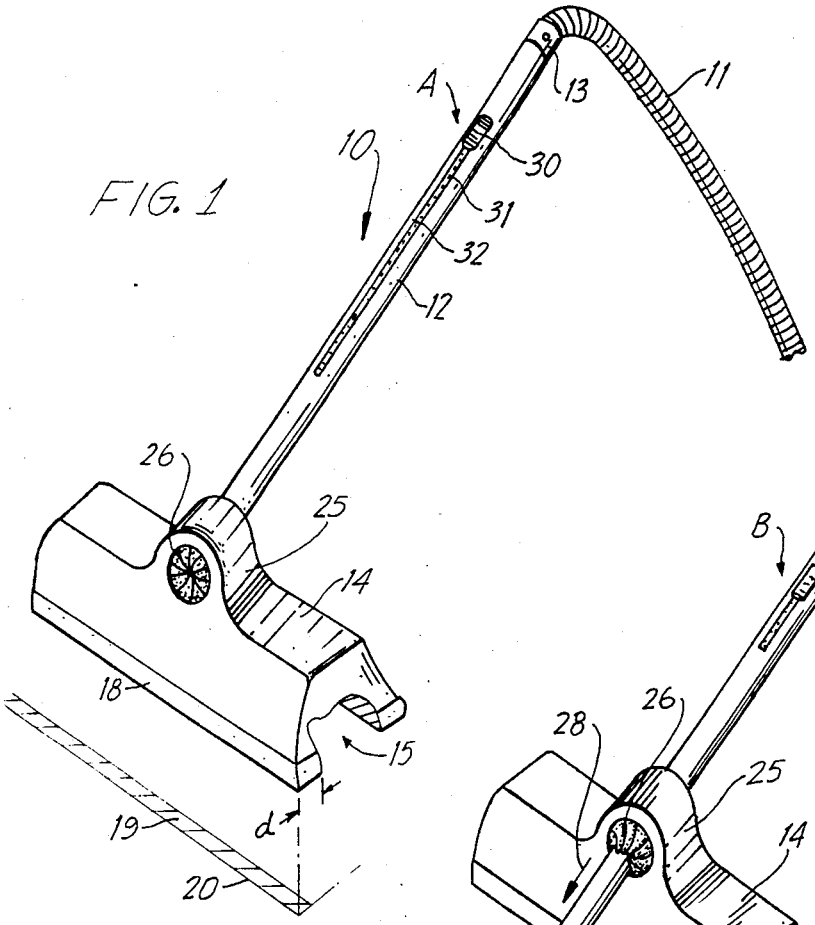
FIG. 1 is a perspective, cut-away view of a floor or rug attachment for a vacuum cleaner, comprising the slidable crevice wand of the invention, with the crevice wand shown in its retracted position.

Now referring to FIG. 1, a floor or rug cleaning apparatus 10 is illustrated.

The floor or rug cleaning apparatus 10 comprises a flexible, hollow suction hose 11 connected to a source of suction, such as a vacuum cleaner cannister (not shown).

A hollow extension tube 12, made of hard plastic or steel, is connected to the flexible hose 11 by a detented coupling 13.

Attached to the extension tube 12 is a floor or rug cleaning housing 14, having a suction conduit 15 (shown in cut-away in FIG. 1).

The housing 14 can be designed as a device for cleaning hard floor coverings of wood, tile or linoleum, or a device for cleaning rugs, both shag and plush.

Figure 3:
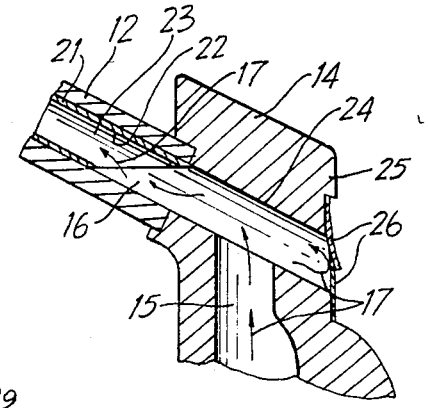
FIG. 3 is an internal, sectional view of the head of the floor or rug attachment of FIGS. 1 and 2, depicting a bifurcated section conduit with the crevice wand disposed therein.

The conduit 15 is in contact with the floor or rug, and operatively communicates with the hollow conduit portion 16 of the extension tube 12, as seen in better detail in FIG. 3.

Suction air (arrows 17) is normally drawn from the floor or rug into the housing conduit 15, and then continues to move towards the vacuum cleaner cannister (not shown) through the intake conduit 16 of the extension tube 12.

The conduit 15 of housing 14 in the ordinary and standard attachments is normally separated a distance "d" from the front face 18 of the housing 14.

As a consequence of this separation, an area 19 at the edge of a wall 20 dis not reachable by the suction, and hence is not cleanable.

For such areas 19, the housing 14 is normally removed, and a crevice tool or attachment is inserted in place of housing 14, onto extension tube 12. This is both time consuming and inconvenient.

Figure 2:
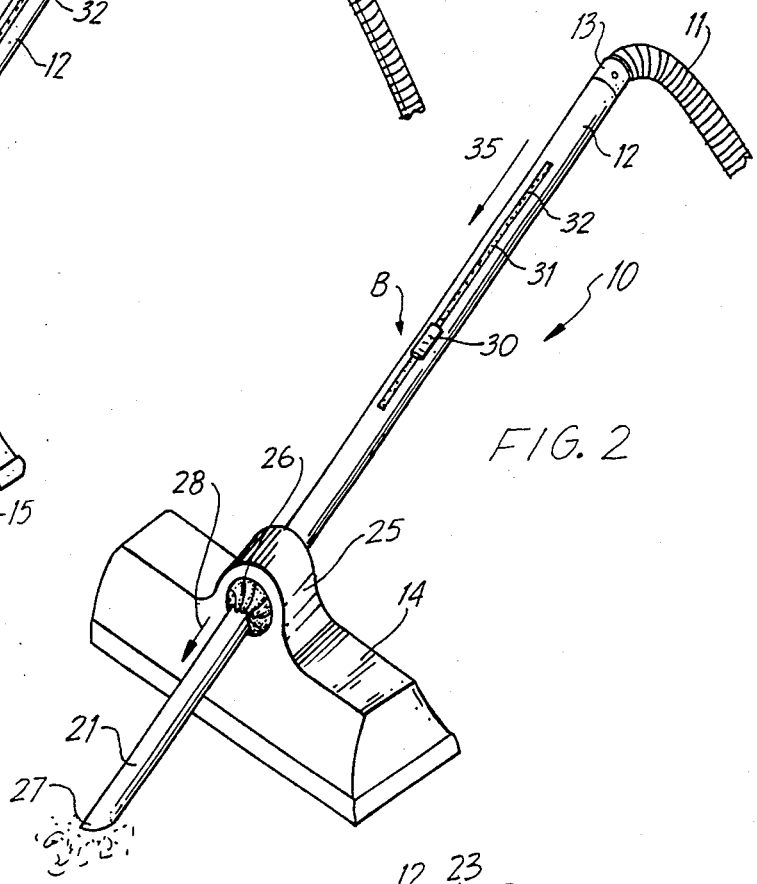
FIG. 2 is a perspective view of the floor or rug attachment of FIG. 1, illustrating the crevice wand in its extended position.
Figure 4:
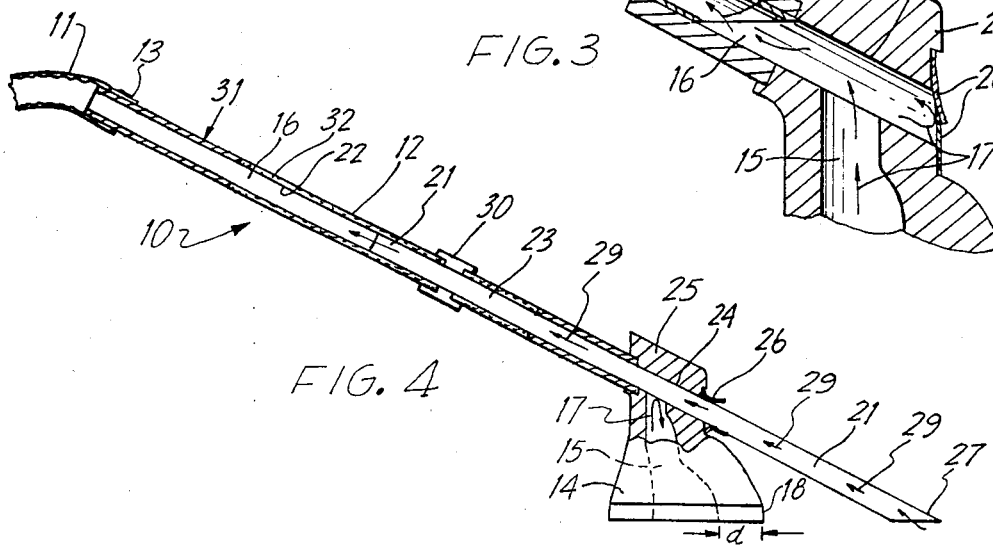
FIG. 4 is a sectional view of the floor or rug attachment of FIG. 2.

The present invention alleviates this drawback by means of a built-in crevice wand 21, as shown in FIGS. 2 and 4.

The crevice wand 21 is slidable within the inner wall 22 (FIGS. 3 and 4) of the extension tube 12. The wand 21 is slidably air-sealed with respect to the inner wall 22, such that air which is being suctioned through housing 14 will pass substantially, if not entirely through hollow 23 of wand 21.

The wand 21 is slidably movable between a retracted position shown in FIGS. 1 and 3, and an extended position shown in FIGS. 2 and 4.

The housing 14 is modified to provide a pathway for the extension of the crevice wand 21.

Conduits 15 and 16 are bifurcated into a second conduit path by means of conduit 24 (FIGS. 3 and 4) disposed in top section 25.

The wand 21 is slidably moved through conduit 24 and eventually emerges through a flexible air seal 26 in the top section 25 of housing 14.

Seal 26 can comprise several overlapping leaves of rubber, which are flexibly parted by the nose 27 of forwardly moving wand 21, as it is thrust forward (arrow 28, FIG. 2) towards its extended position.

In the retracted position shown in FIG. 3, seal 26 acts to prevent a dilution of suction power by preventing suction air (arrow 17) from entering through top section 25, as illustrated.

In the extended position, seal 26 acts to prevent air from entering between the wand 21 and inner walls 22, thus causing only air to flow up the wand 21, as depicted by arrows 29 in FIG. 4.

Also, in the extended position, air flow (arrow 17) from the floor conduit 15 is blocked by the wand 21, which cuts off the conduit 15, as shown in FIG. 4.

When the crevice wand 21 is extended, as illustrated in FIGS. 2 and 4, the wall crevice area 19 depicted in FIG. 1 can now be easily cleaned as well as other hard-to-reach areas. The nose 27 of wand 21 will easily access and provide suction to these inaccessible areas.

The wand 21 is slidably extended by means of knob 30 shown in FIGS. 1, 2 and 4.

Knob 30 is affixed to wand 21, or is an integral section thereof. As shown in FIG. 4, knob 30 extends through an elongated slot 31 in extension tube 12.

A flexible air seal 32 of rubber, is disposed in slot 31 to maintain suction in conduit 16.

The seal 32 has biased or overlapping leaves (not shown) forming a slit therein, by which knob 30 can traverse the slot 31 from the retracted position "A" depicted in FIG. 1, to the extended position "B" shown in FIG. 2.

When the wand 21 is to be slidably moved from position "A" to position "B", it is held in one hand, while the other hand hold extension tube 12.

It is then thrust forward (arrow 35), as illustrated in FIG. 2. To retract the wand 21, a reverse procedure is utilized, i.e. the knob 30 is pulled backward from position "B", while holding extension tube 12 in place.

Having described the invention, what is desired to be protected by Letters Patent is presented by the subsequently appended claims.

What is claimed is:

1. A suction cleaning device for cleaning hard-to-access areas such as crevices and corners, comprising:

a hollow suction tube extension for a vacuum cleaner having a slotted portion therein, said suction tube extension having an inner wall defining a suction pathway, and an outer wall;

a housing attachment affixable to said hollow suction tube extension, said housing attachment having a surface cleaning mouth portion operatively communicating with said suction pathway;

an extendable crevice wand operatively communicating with said suction pathway and slidably supported by said suction tube extension, said wand being movable between a first retracted position and a second extended position, said second position placing a mouth portion of said crevice wand ahead of said housing attachment, whereby said crevice wand is reachable into hard-to-access areas; and a hand-held appurtenance supported by said crevice wand and extending through said slotted portion in said suction tube extension for slidably moving said crevice wand between said first and second positions.

2. The suction cleaning device of claim 1, wherein said wand is slidably disposed within said suction tube extension.

3. The suction cleaning device of claim 1, wherein said housing attachment has a conduit extending therethrough from a point of attachment with said suction tube extension to an opening in a face portion thereof, said crevice wand being movable through said conduit and said opening.

4. The suction cleaning device of claim 3, wherein a flexible seal is disposed about said opening in said face portion of the housing attachment.

5. The suction cleaning device of claim 1, wherein a flexible seal is disposed about said slotted portion of said suction tube extension.

* * * * *